United States Patent [19]

Puchta et al.

[11] Patent Number: 4,814,095

[45] Date of Patent: Mar. 21, 1989

[54] AFTER-WASH TREATMENT PREPARATION BASED ON LAYER SILICATE

[75] Inventors: Rolf Puchta, Haan; Hans Nuesslein, Langenfeld; Theodor Voelkel, Duesseldorf, all of Fed. Rep. of Germany

[73] Assignee: Henkel Kommanditgesellschaft auf Aktien, Duesseldorf, Fed. Rep. of Germany

[21] Appl. No.: 126,447

[22] Filed: Nov. 30, 1987

[30] Foreign Application Priority Data

Dec. 3, 1986 [DE] Fed. Rep. of Germany ..... 3641314

[51] Int. Cl.[4] ..... D06M 5/00; D06M 3/00

[52] U.S. Cl. ..... 252/8.6; 252/8.8

[58] Field of Search ..... 252/8.6

[56] References Cited

U.S. PATENT DOCUMENTS

| | | | |
|---|---|---|---|
| 3,686,025 | 8/1972 | Morton | 117/140 |
| 3,843,395 | 10/1974 | Morton | 117/109 |
| 3,920,563 | 11/1975 | Wixon | 252/8.75 |
| 3,989,631 | 11/1976 | Marsan | 252/8.6 |
| 4,055,248 | 10/1977 | Marsan | 206/0.5 |
| 4,099,912 | 7/1978 | Ehrlich | 8/137 |
| 4,237,155 | 12/1980 | Kardouche | 427/242 |
| 4,308,024 | 12/1981 | Wells | 8/137 |
| 4,379,059 | 4/1983 | Hockey et al. | 252/8.8 |
| 4,401,578 | 8/1983 | Verbruggen | 252/8.8 |
| 4,414,130 | 11/1983 | Cheng | 252/140 |
| 4,426,299 | 1/1984 | Verbruggen | 252/8.8 |
| 4,472,287 | 9/1984 | Ramachandran et al. | 252/8.7 |
| 4,569,773 | 2/1986 | Ramachandran et al. | 252/8.7 |

FOREIGN PATENT DOCUMENTS

| | | |
|---|---|---|
| 107479 | 10/1983 | European Pat. Off. . |
| 122140 | 4/1984 | European Pat. Off. . |
| 0107479 | 5/1984 | European Pat. Off. . |

*Primary Examiner*—John F. Niebling
*Assistant Examiner*—Isabelle Rodriguez
*Attorney, Agent, or Firm*—Ernest G. Szoke; Wayne C. Jaeschke; Real J. Grandmaison

[57] ABSTRACT

An after-wash textile treatment preparation containing natural and/or synthetic layer silicates as the softening component in combination with an acidic compound, a disintegrating agent, a filler or a carrier material and, optionally, a binder and fatty acid ester. The preparation is used in the rinse cycle of a laundry washing process.

10 Claims, No Drawings

AFTER-WASH TREATMENT PREPARATION BASED ON LAYER SILICATE

BACKGROUND OF THE INVENTION

1. Field of the Invention

This invention relates to an after-wash treatment preparation based on natural and synthetic layer silicates which is particularly suitable for rinse-cycle softening of textiles.

2. Description of Related Art

After washing and drying, textile fabrics can tend to have a hard, unpleasant feeling on the skin because of the hardness of the water. In order to restore or improve the softness or fluffiness of the fabrics, the articles of laundry may be treated before drying with so-called fabric softeners whih give the fabrics a soft feel by various mechanisms. These fabric softeners are generally cationic compounds a large number of which have been proposed in the field of fabric softeners. Besides fabric softening preparations based on cationic fabric softeners, synergistic combinations of different cationic compounds alone or in admixture with surfactants and other additives (for example fatty acids, soaps, glycerol esters) have been proposed (cf. for example German patent application No. 29 43 606, German patent application No. 23 52 955, European Pat. No. 0 051 983, European patent application No. 0 122 140, European Pat. No. 0 013 780 and European patent application No. 0 107 479). Fabric softeners based on these active components are primarily intended for use in the rinse cycle following the washing process. These active substances may also be used in tumble dryers in the form of sheets coated with active substances (cf. German patent application No. 19 65 470 and European Pat. No. 0 007 135). Another method of fabric care in the laundry field is to use a fabric-softening compound as a constituent of a detergent formulation. Besides cationic active substances and a number of other additives, compounds known generically as layer silicates have been proposed as a softening component in detergent formulations (German patent application Nos. 33 44 098 and 25 26 248). It has been found from extensive investigations, however, that the softening effect of commercial fabric softeners in rinse-cycle softening is not even approached by wash-cycle softening.

Accordingly, an object of the present invention is to provide a highly effective after-wash treatment preparation based on layer silicates for rinse-cycle softening of textiles.

In the course of extensive development work, the poor dispersibility in water and the high pH value of the rinse solution were found to be serious drawbacks with respect to known after-wash treatment preparations where layer silicates are used without additives. After-wash treatment preparations based on layer silicates which have the features of a fabric-care after-treatment preparation must have the following performance characteristics;

- good softening power,
- high water uptake capacity of the treated fabrics,
- good antistatic finishing of the fabrics,
- good dispersibility in water,
- good dispensability from the dispensing compartments of washing machines,
- good product stability, and
- good perfumability of the product and the laundry tested therewith.

DESCRIPTION OF THE INVENTION

Other than in the operating examples, or where otherwise indicated, all numbers expressing quantities of ingredients or reaction conditions used herein are to be understood as modified in all instances by the term "about".

It has now been found that layer silicate-based after-wash treatment preparations according to this invention formulated in a particular manner have a unexpected, good softening effect in rinse-cycle softening textiles. The after-wash treatment preparation according to this invention comprises;

(a) from 5 to 80% by weight of at least one natural and/or synthetic layer silicate, (b) from 1 to 20% by weight of a neutralizing agent or souring agent selected from citric acid, maleic acid, oxalic acid, lactic acid, and toluenesulfonic acid, (c) from 1 to 20% by weight of at least one disintegrating agent comprising citric acid hydrogen carbonate, (d) from 1 to 30% by weight of at least one filler or carrier substance selected from ammonium sulfate, zeolite A, and urea, (e) from 0 to 50% by weight of at least one binder, and (f) from 0 to 10% by weight of a fatty acid ester.

Highly swellable, finely divided natural or synthetic layer silicates have been known as fabric softeners for many decades. Smectites in particular have often been mentioned as fabric softeners in detergents. Synthetic or semi-synthetic, water-insoluble, finely divided layer silicates having a smectite structure, and in particular, the corresponding hectorites, saponites and montmorillonites are also well-known commercial products for numerous applications. A crucial factor in their use is always the high swellability which is attributable to the ability of this class of layer silicates to be able to incorporate water and/or inorganic cationic compounds in their crystal lattice with widening of the layer intervals. Layer silicates and, in particular, montmorillonite, hectorite and saponite are deposited in thin layers on the textile fibers and thus influence the softness and feel of the washed fabrics. Combining the washing and softeninhg of fabrics into a single process in this way is, inter alia, the subject of German patent application No. 23 34 899. The swellable smectites described therein with their softening properties may also be used in the after-wash treatment preparations according to the present invention.

In addition to citric acid, virtually any water-soluble acid and particularly crystalline forms thereof, such as maleic acid, oxalic acid, lactic acid or toluenesulfonic acid, may be used as a neutralizing agent or a souring agent for pH regulation of skin-compatible fabric-softening rinse liquors containing a quantity of layer silicate.

A distinct improvement in the water dispersibility of after-wash treatment preparations based on layer silicates may be achieved by adding a disintegrating agent as a constituent of the formulation. Disintegrating agents suitable for the purpose of the present invention include citric acid/hydrogen carbonate and combinations of hydrogen carbonate and/or carbonate salts with the acids used for pH regulation and also virtually any substance which acts as a disintegrating agent in conjunction with water by virtue of their chemical structure.

Virtually any water-soluble salt of an organic and inorganic acid and base may be used as a filler or carrier material for after-wash treatment preparations based on the compositions according to the invention. Fillers are generally auxiliaries for improving dispersibility in the manufacture of powder-form products. They promote free flow and prevent clumping or dust formation. So-called carrier materials, such as urea for example, are substances by which other, generally liquid formulation constituents, such as perfume oils or nonionic dispersants, may be homogeneously mixed in powder-form products without their powder properties being adversely affected. Accordingly, both groups of substances serve to optimize or maintain the powder properties of corresponding preparations. There is no difference in principle between fillers and carriers. So far as the product properties of layer silicates is concerned, some overlap with the auxiliaries described as fillers and carriers is permissible. However, the layer silicates claimed as the principal component are distinguished from all other constituents in the context of the present invention by a crucial performance feature, namely their fabric-softening property. Suitable salts include those which, in ecological terms, do not adversely affect the environment. Within the group of carrier materials, zeolite A is preferred because it has been found that zeolite A forms suitable powder mixtures with the finely divided layer silicates. Another preferred carrier material is urea. Besides showing properties which contribute towards preparation of the powders, urea serves as a perfume oil carrier in the powder-form after-wash textile treatment preparations.

In addition to the basic material components, the after-wash treatment preparations according to the invention may contain special binders having dispersing properties. In the context of the present invention, suitable binders include capillary-active products which owe their hydrophilic properties to the presence of special functional groups and, quite generally, to an accumulation of hydroxyl groups. Polyglycolethers for example belong to this category. Suitable polyglycolethers include those derived from ethylene oxide having a molecular weight in the range of from 200 8000, preferably in the range of from 200 to 1000, and more preferably in the range of from 400 to 600. Other suitable additives include adducts obtained by the addition of ethylene oxide and/or propylene oxide onto fatty alcohols, fatty acids, fatty amines, fatty acid or sulfonic acid amides, polyethylene or polypropylene glycols, epoxyglycols, alkylenediamine or aliphatic $C_1$–$C_8$, and preferably $C_3$–$C_6$, alcohols. In addition to the low molecular weight polyglycol ethers mentioned above, high molecular weight glycol ethers having molecular weights of from about 10,000 to 80,000 are also suitable for use in the compositions according to the invention. 2-benzyl-alcohol polyglycol ehters containing 2 to 10 moles of ethylene oxide are also suitable as additives, particularly when the basic alcohol component is 2-benzyl octanol. In many cases, adducts of from 2 to 10 moles of ethylene oxide with branched alcohols, such as isotridecanol for example, and also hydroxyl-substituted fatty alcohols may also be successfully used as additives. 1,4-alkyl glycosides and 2,2-alkyl glycosides containing $C_{10}$–$C_{20}$ alkyl radicals are also suitable additives in the composition of this invention. Paraffin oil is also a suitable additive herein. Polyhydric alcohols, for example ethylene glycol, propylene glycol or glycerol, are also suitable. In many cases, the addition of various substances from other classes of compounds promotes optimization of the product. Other suitable additives include ether amines corresponding to the formula $R—(C_2H_4O)_n—NR^1R^2$.

In the afore-mentioned formula, R is a $C_{10}$–$C_{20}$ alkyl radical, n is a number of from 2 to 10, $R^1$ and $R^2$, which may be the same or different, represent $C_2H_4OH$ or esters thereof with $C_{10}$–$C_{20}$ monocarboxylic acid or sulfosuccinic acid or alkali metal salts of these acids. Also suitable are quaternary ammonium salts of the last-mentioned compounds in which another $C_1$–$C_{18}$ alkyl group is attached to the nitrogen atom, forming a positive charge which is neutralized by an anion establishing electroneutralilty, generally the chloride anion.

In one embodiment of the invention, the binders of the after-wash treatment preparations according to the invention comprise:

(a) a polyglycol ether derived from ethylene oxide and having a molecular weight in the range from 200 to 8000 and preferably in the range from 200 to 1000, (b) an adduct of ethylene oxide and/or propylene oxide with a fatty alcohol, fatty acid, fatty amine, fatty acid or sulfonic acid amide, polyethylene or polypropylene glycol, epoxyglycol, alkylene-diamine or aliphatic $C_1$–$C_8$ and preferably $C_3$–$C_6$ alcohol, (c) a high molecular weight glycol ether having a molecular weight of from 10,000 to 80,000, (d) a 2-benzyl alkanol polyglycol ether containing 2 to 10 moles ethylene oxide wherein the basic alcohol component is 2-benzyloctanol, (e) an adduct of 2 to 10 moles of ethylene oxide with a branched-chain alcohol, such as isotridecanol and a hydroxyl-substituted fatty alcohol, (f) a 1,4- and 2,2-alkylglycoside containing a $C_{10}$–$C_{20}$ alkyl radical, (g) paraffin oil, (h) a polyhydric alcohol selected from ethylene glycol, propylene glycol or glycerol, (i) an ether amine corresponding to the formula $$R—(C_2H_4O)_n—NR^1R^2$$

wherein

R is a $C_{10}$–$C_{20}$ alkyl radical, n is an integer of from 2 to 10, $R^1$ and $R^2$, which may be the same or different, represent $C_2H_4OH$ or an ester thereof with a $C_{10}$–$C_{20}$ monocarboxylic acid or sulfosuccinic acid or the alkali metal salt of these acids, and/or (j) a quaternary ammonium salt of the compounds mentioned in (i) in which another $C_1$–$C_{18}$ alkyl group is attached to the nitrogen atom, forming a positive charge which is neutralized by an anion establishing electroneutrality, preferably a chloride ion.

In another embodiment of the invention, the molecular weight of the above-mentioned groups of polyglycol ethers derived from ethylene oxide is preferably in the range of from 400 to 600.

A fatty acid ester may be additionally used to further improve the fabric-care properties of the compositions of this invention. Suitable fatty acid esters used in accordance with the invention may be derived from monohydric and polyhydric alcohols and mono- or polycarboxylic acids, the carbon chain of the alcohols containing from 1 to 22 carbon atoms, and that of the mono- or polycarboxylic acids from 1 to 24 carbon atoms, the number of carbon atoms in the ester being 16 or greater and one of the carbon residues in the ester containing at least 12 or more carbon atoms.

Ethylene glycol glycerol and sorbitan esters are preferred fatty acid esters, the adducts of up to 20 moles ethylene oxide and/or propylene oxide with the above-mentioned fatty acid esters also being suitable for use in accordance with the invention. According to the invention, preferred esters are those selected from ethylene glycol stearate, mono-, di- and triglycerides of saturated and unsaturated $C_{12}$–$C_{22}$ fatty acids and also sorbitan mono-, di- and triesters, with the proviso that the acid esters in the sorbitan ester have a chain length of $C_{12}$ to $C_{22}$.

In one embodiment, after-wash treatment preparations according to the invention may contain adducts containing up to 20 moles of ethylene oxide and/or propylene oxide as the fatty acid ester.

After-wash treatment preparations according to the invention may also contain other components. An after-wash treatment preparation according to the invention may advantageously be characterized in that it contains additives specific to the active substances, such as oxygen carriers, bleach activators, antibacterial agents, and soil release agents.

In another embodiment, the after-wash treatment preparation according to the invention is preferably characterized in that it is blended with known dispersants to provide a liquid, paste-like, granular or tablet-like composition.

Fabric softeners based on the claimed combination of active substances may be produced by the single-powder or multiple-powder technique. In the single-powder technique, certain raw-material components are homogeneously mixed with suitable dispersants, subsequently dried, size-reduced or powdered in special machines and then mixed with the other constituents. However, the dispersed intermediate product may also be sprayed to a powder. In the multiple-powder technique, the individual constituents of the product are mixed in special homogenizers to form a fine or coarse powder.

In another formulation of fabric softener based on the claimed active components, the constituents of the formulation are blended with anhydrous dispersants to form a liquid or paste-like product. Suitable dispersants include the capillary-active products mentioned above.

If a quantity, for example 2.5 g, of an after-wash treatment preparation according to the invention based on layer silicates is applied to the surface of water (500 ml), this quantity of product disperses spontaneously in the water after a relatively short time (approx. 30 seconds). A homogeneous, milky white softening liquor is obtained by slight mechanical agitation, e.g. such as gentle stirring with a rod.

By contrast, 2.5 g of a commercial layer silicate (Laundrosil DG) can only be homogeneously dispersed in the water after prolonged and vigorous mechanical agitation. Accordingly, layer silicates without any other additives are unsuitable in practice for textile after-wash treatments.

Dispensing tests in critical dispensing compartments of domestic laundry washing machines have shown that, where 60 g of formulation according to Example 1 below is used, virtually no residues of product remain in the dispensing compartments although these compartments were designed for liquid laundry softener products. Dispensing tests using 36 g of the commercial layer silicate mentioned above produced unacceptable product residues in the dispensing compartments of the laundry washing machines.

The invention is illustrated by the following Examples.

EXAMPLES

A raw-material mixture of 60% by weight Laundrosil DG (natural calcium-sodium bentonite), 5.0% by weight citric acid WFR, 10.0% by weight sodium hydrogen carbonate, 5.0% by weight potassium toluenesulfonate, 10.0% by weight ammonium sulfate, 5.0% by weight urea, 4.7% by weight glycerol and 0.3% by weight perfume oil was prepared as follows:

The individual constituents, apart from perfume oil, were mixed with a wooden spatula in an 800 ml glass beaker. The mixture was then poured into a household mixer and intensively sheared for a short time. During the shearing, the mixture was perfumed using a perfume atomizer. Finally, the perfumed mixture was shaken for about 30 minutes in a Turbula shaking mixer.

The after-wash treatment preparation as described above was compared with a comparison product based on cationic surfactants under practical conditions in domestic wshing machines using various test fabrics of pure cotton, pure wool and various blends. The active-substance concentration of the various after-treatment preparations, as normally used in after-wash treatment preparations, was the same throughout.

Evaluation of the after-treated test fabrics showed that compositions according to the invention, as in Example I below, are comparable in their softening effect with known after-wash treatment preparations based on cationic surfactants.

After-wash treatment preparations based on the claimed combination of active substances may be provided with specific additives according to the product formulation as shown in Examples 2 to 5 below. Thus, it is possible to use perborate monohydrate for example as an oxygen carrier, TAED (tetraacetyl ethylenediamine) for example as a bleach activator, toluenesulfonic acid chloramide (Chloramine T) for example as an anti-bacterial agent and monoalkyl trimethyl ammonium chloride or bromide for example, such as tetradecyl trimethyl ammonium bromide (TDTMA-BR), as a soil release agent. Active-substance combinations prepared as described above are shown in Table 1 below:

TABLE 1

| | Example | | | | |
|---|---|---|---|---|---|
| Constituents (% by weight) | 1 | 2 | 3 | 4 | 5 |
| Laundrosil DG | 60 | 60 | 60 | 60 | 60 |
| Citric acid WFR | 5 | 5 | 5 | 5 | 5 |
| Sodium hydrogen carbonate | 10 | 10 | 10 | 10 | 10 |
| Potassium toluenesulfonate | 5 | 5 | 5 | 6 | 5 |
| Ammonium sulfate | 10 | 5 | 5 | 11 | 10 |
| Urea | 5 | 4.7 | 4.7 | 4.7 | 4.7 |
| Glycerol | 4.7 | — | — | — | — |
| Perborate monohydrate | — | 10 | 8 | — | — |
| TAED | — | — | 2 | — | — |
| Chloramine T | — | — | — | 3 | — |
| TDTMA-BR | — | — | — | — | 5 |
| Perfume oil | 0.3 | 0.3 | 0.3 | 0.3 | 0.3 |

In another formulation of after-wash laundry treatment preparations based on the claimed active components, the constituents of the formulation may be blended with anhydrous dispersants to form liquid to paste-like products. Suitable dispersants include the capillary active products mentioned above.

In addition to the preparation of powder-form and liquid to paste-like products, it is also possible to prepare granulate-like fabric softeners based on layer silicates. In another preparation, the powder- and paste-form products may be packed for example in water-soluble bags, or suitable active-substance mixtures may be tabletted, ready for addition to textile fabric rinse liquors.

What is claimed is:

1. An after-wash textile treatment preparation comprising a softening composition containing the following ingredients:

(a) from about 5 to about 80% by weight of at least one natural or synthetic layer silicate, (b) from about 1 to about 20% by weight of a neutralizing agent selected from citric acid, maleic acid, oxalic acid, lactic acid, and toluenesulfonic acid, (c) from about 1 to about 20% by weight of at least one disintegrating agent selected from the group consisting of citric acid, sodium hydrogen carbonate, and mixtures thereof, (d) from about 1 to about 30% by weight of at least one filler or carrier material selected from ammonium sulfate, zeolite A, and urea, (e) from 0 to about 50% by weight of at least one binder, and (f) from 0 to about 10% by weight of a fatty acid ester.

2. An after-wash textile softener preparation as in claim 1 wherein said binder is selected from the group consisting of (a) a polyglycol ether derived from ethylene oxide and having a molecular weight of from about 200 to about 8000, (b) an adduct of ethylene oxide or propylene oxide with a fatty alcohol, fatty acid, fatty amine, fatty acid or sulfonic acid amide, polyethylene or polypropylene glycol, epoxy glycol, alkylenediamine or aliphatic $C_1$–$C_8$ alcohol, (c) a high molecular weight glycol ether having a molecular weight of from about 10,000 to about 80,000, (d) a 2-benzyl alkanol polyglycolether containing about 2 to about 10 moles of ethylene oxide wherein the basic alcohol component is 2-benzyl alcohol, (e) an adduct of from about 2 to about 10 moles of ethylene oxide with a branched-chain alcohol selected from isotridecanol and a hydroxy-substituted fatty alcohol, (f) a 1,4- and 2,2-alkyl glycoside containing a $C_{10}$–$C_{20}$ alkyl radical, (g) paraffin oil, (h) a polyhydric alcohol selected from ethylene glycol, propylene glycol or glycerol, (i) an ether amine corresponding to the formula $$R—(C_2H_4O)_n—NR^1R^2$$

wherein

R is a $C_{10}$–$C_{20}$ alkyl radical, n is an integer of from 2 to 10, $R^1$ and $R^2$ may be the same or different, and represent $C_2H_4OH$ or an ester thereof with a $C_{10}$–$C_{20}$ monocarboxylic acid, sulfosuccinic acid, the alkali metal salt of these acids, and (j) a quaternary ammonium salt of the compounds mentioned in (i) in which another $C_1$–$C_{18}$ alkyl group is attached to the nitrogen atom, forming a positive charge which is neutralized by an anion establishing electroneutrality.

3. An after-wash textile softener preparation as in claim 2 wherein the molecular weigh of said polyglycol ether derived from ethylene oxide is in the range from about 200 to about 1,000.

4. An after-wash textile softener preparation as in claim 1 wherein said fatty acid ester is derived from a mono- or polyhydric alcohol and a mono- or polycarboxylic acid, the carbon chain of said alcohol containing from 1 to 22 carbon atoms and that of said mono- or polycarboxylic acid from 1 to 24 carbon atoms, the number of carbon atoms in said ester being 16 or greater and one of the carbon residues in the ester containing at least 12 or more carbon atoms.

5. An after-wash textile softener preparation as in claim 4 wherein said fatty acid ester is selected from the group consisting of ethylene glycol stearate, a mono-, di- and triglyceride of a saturated and unsaturated $C_{12}$–$C_{22}$ fatty acid, and from sorbitan mono-, di-, and triesters, with the proviso that the acid ester in the sorbitan ester have a chain length of $C_{12}$ to $C_{22}$.

6. An after-wash textile softener preparation as in claim 4 wherein said fatty acid ester comprises an adduct containing up to 20 moles ethylene oxide or propylene oxide.

7. An after-wash textile softener preparation as in claim 1 including an additive selected from the group consisting of an oxygen carrier, bleach activator, antibacterial agent, and soil-release agent.

8. An after-wash textile softener preparation as in claim 1 blended with a dispersant to provide a liquid, paste-like, granular, or tablet-like composition.

9. An after-wash textile softener preparation as in claim 1 wherein said layer silicate has a smectite structure.

10. An after-wash textile softener preparation as in claim 9 wherein said layer silicate is selected from hectorite, saponite and montmorillonite.

* * * * *

UNITED STATES PATENT AND TRADEMARK OFFICE

CERTIFICATE OF CORRECTION

PATENT NO. : 4,814,095

DATED : March 21, 1989

INVENTOR(S) : Puchta et al.

It is certified that error appears in the above-identified patent and that said Letters Patent is hereby corrected as shown below:

In claim 3, at column 8, line 20, "weigh" should read --weight--.

Signed and Sealed this

Twelfth Day of December, 1989

*Attest:*

JEFFREY M. SAMUELS

*Attesting Officer* *Acting Commissioner of Patents and Trademarks*